US006840359B2

(12) United States Patent
Godshaw

(10) Patent No.: US 6,840,359 B2
(45) **Date of Patent: *Jan. 11, 2005**

(54) WHEEL SYSTEM WITH SIDE WHEELS FOR LUGGAGE

(75) Inventor: Donald E. Godshaw, Evanston, IL (US)

(73) Assignee: Travel Caddy, Inc., Des Plaines, IL (US)

( * ) Notice: Subject to any disclaimer, the term of this patent is extended or adjusted under 35 U.S.C. 154(b) by 10 days.

This patent is subject to a terminal disclaimer.

(21) Appl. No.: 10/388,312

(22) Filed: Mar. 13, 2003

(65) Prior Publication Data

US 2003/0132078 A1 Jul. 17, 2003

Related U.S. Application Data

(63) Continuation-in-part of application No. 09/839,007, filed on Apr. 20, 2001, now Pat. No. 6,561,327.

(60) Provisional application No. 60/198,892, filed on Apr. 21, 2000.

(51) Int. Cl.[7] ..... A47B 91/00

(52) U.S. Cl. ..... 190/18 A; 16/47

(58) Field of Search ..... 190/18 A; 16/113.1, 16/47, 48; 280/47.315, 47.371, 37, 655

(56) References Cited

U.S. PATENT DOCUMENTS

| | | | | | |
|---|---|---|---|---|---|
| 3,363,713 | A | * | 1/1968 | Blonsky | 180/291 |
| 4,161,803 | A | * | 7/1979 | Propst et al. | 16/18 A |
| 4,457,045 | A | * | 7/1984 | Kegg | 16/18 A |
| 5,992,588 | A | * | 11/1999 | Morszeck | 190/18 A |
| 6,561,327 | B1 | * | 5/2003 | Godshaw | 190/18 A |

* cited by examiner

*Primary Examiner*—Tri M. Mai
(74) *Attorney, Agent, or Firm*—Banner & Witcoff, Ltd.

(57) ABSTRACT

A dual wheel assembly is provided at corners of an item of luggage to facilitate pulling of the luggage in various directions by means of a handle such as a telescopic handle for the luggage.

4 Claims, 3 Drawing Sheets

FIG.1
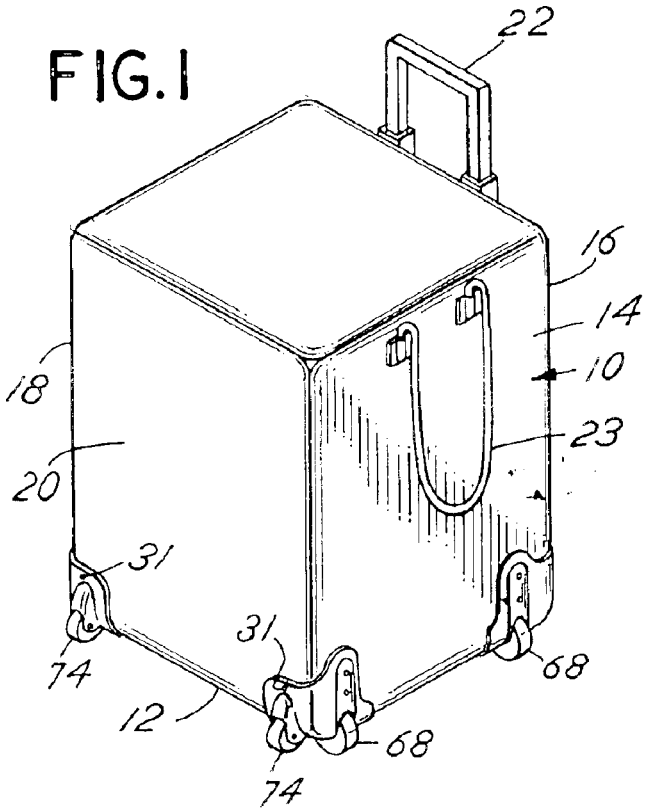
FIG.4
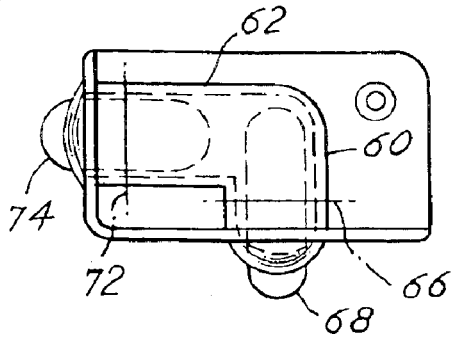
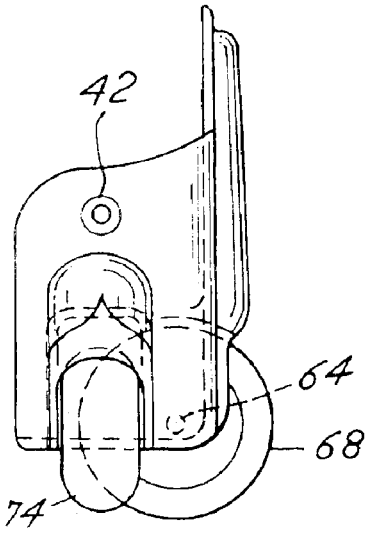
FIG.3
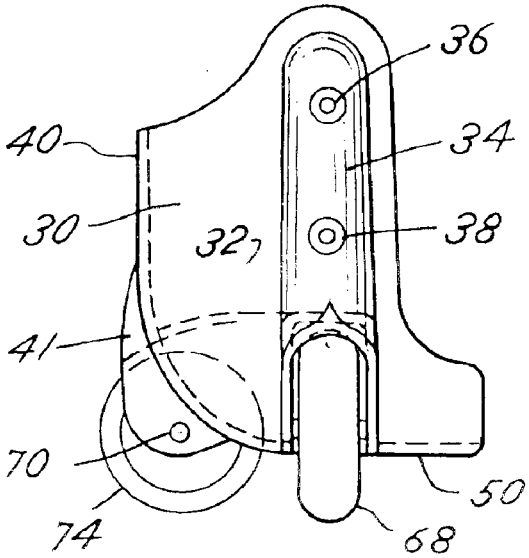
FIG.2

FIG.5
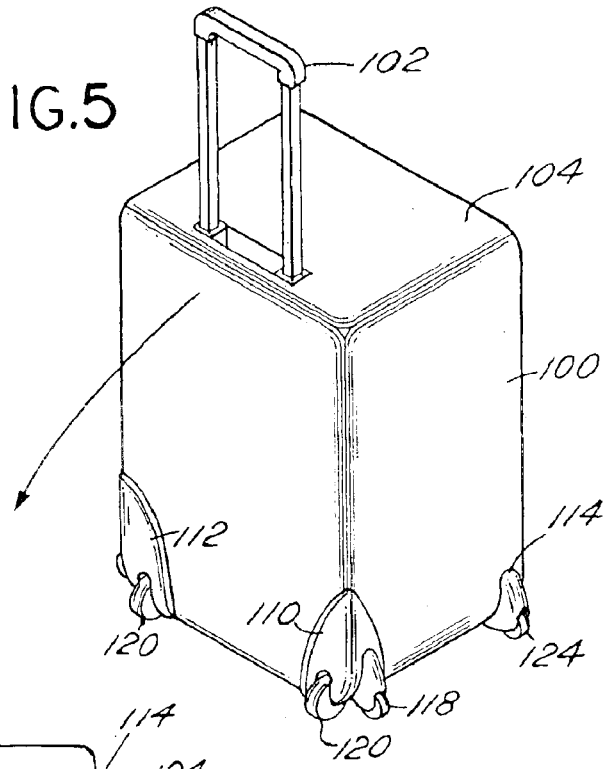
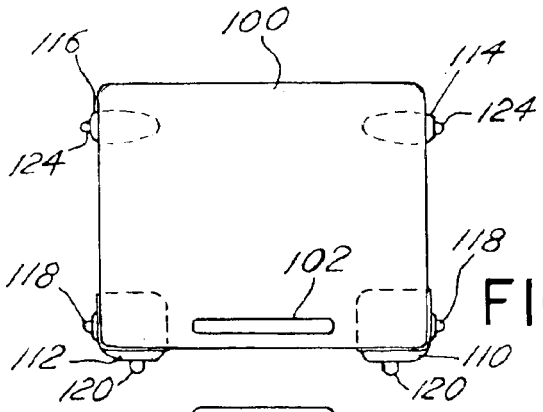
FIG.6
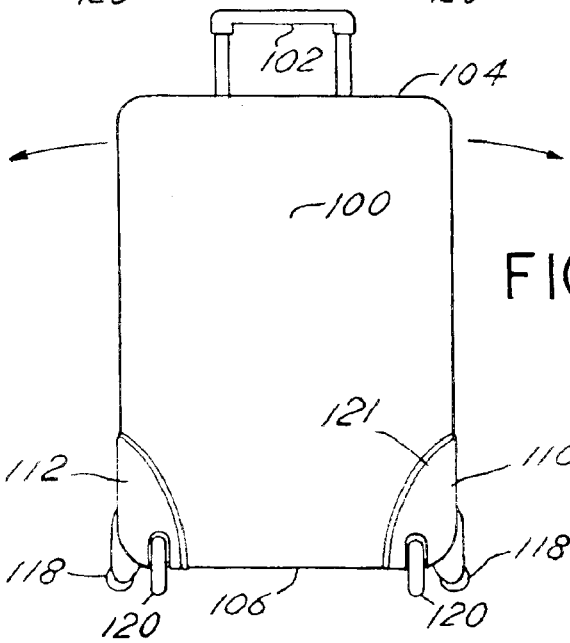
FIG.7

WHEEL SYSTEM WITH SIDE WHEELS FOR LUGGAGE

CROSS REFERENCE TO RELATED APPLICATION

This is a utility application which is a continuation in part of Ser. No. 09/839,007 filed Apr. 20, 2001 (now U.S. Pat. No. 6,561,327) for which priority is claimed and which is based upon previously filed provisional application, Ser. No. 60/198,892 filed Apr. 21, 2000, for which priority is claimed.

BACKGROUND OF THE INVENTION

In a principal aspect the present invention relates to a construction for the wheels utilized in combination with luggage. The use of wheels attached to the side or edges of luggage containers is a common expedient. Wheels in combination with luggage and with a telescoping handle or pullstrap are now common occurrences, and many variations of products of this nature are available. Typically the wheels are provided in pairs and are attached to a lower edge or bottom of the luggage.

In this manner transport of the luggage in a particular direction is facilitated. However, to alter the direction or alter the orientation of the luggage which is being transported via the wheels becomes impractical. In other words, the wheels are typically attached to the luggage with the intention that the luggage will be pulled along a surface in a particular direction and in a particular manner. The option or possibility of reorienting the luggage for pulling in a different direction is typically not a capability of a wheeled system particularly a system involving two parallel wheels. Thus there has developed a need for a wheeled system which will enable alteration in the orientation of transport of the luggage by means of the wheels.

SUMMARY OF THE INVENTION

Briefly, the present invention comprises a wheel construction which may be positioned at the corners and preferably at three or four corners of a parallelapiped shaped luggage item wherein each wheel construction includes two wheels orientated at a 90 degree angle with respect to each other. In this manner the luggage may be toted or pulled along the ground in at least two, non-opposite directions. In a preferred embodiment such a wheel construction is attached to each of the four bottom corners of an item of luggage thus enabling transport of the luggage item in substantially any of four directions or orientations.

Thus it is an object of the invention to provide an improved wheel construction or housing for an item of luggage.

It is a further object of the invention to provide items of luggage wherein multiple sets of multiwheeled housings are attached to the item of luggage.

Yet another object of the invention is to provide a wheel construction wherein two wheels oriented at 90 degrees with respect to one another are provided at each corner of a luggage item on at least at three of the four corners of a parallelapiped item of luggage.

Yet another object of the invention is to provide a wheel housing which is lightweight, of simple construction, economical, and which does not require inordinate space when attached to luggage thereby avoiding encroachment upon the capacity of an item of luggage.

There and other objects, advantages, and features of the invention will be set forth in greater detail in the description which follows.

BRIEF DESCRIPTION OF THE DRAWING

In the detailed description which follows, reference will be made to the drawing comprised of the following figures:

FIG. 1 is an isometric view of an item of luggage or a case which includes a wheel assembly positioned at each of the four corners of the rectangular base of the case;

FIG. 2 is a side elevation of a wheel assembly;

FIG. 3 is an end view of the wheel assembly of FIG. 2;

FIG. 4 is a top plan view of the wheel assembly of FIG. 2;

FIG. 5 is an isometric view of an item of luggage which includes a wheel assembly positioned at each of the four corners of the rectangular base of the luggage item wherein two of the four corners include a wheel assembly having a pair of wheels arranged at substantially right angles with respect to each other;

FIG. 6 is a top plan view of the luggage item of FIG. 5;

FIG. 7 is a side elevation of the luggage item of FIG. 5;

DESCRIPTION OF THE PREFERRED EMBODIMENT

Figure 8:
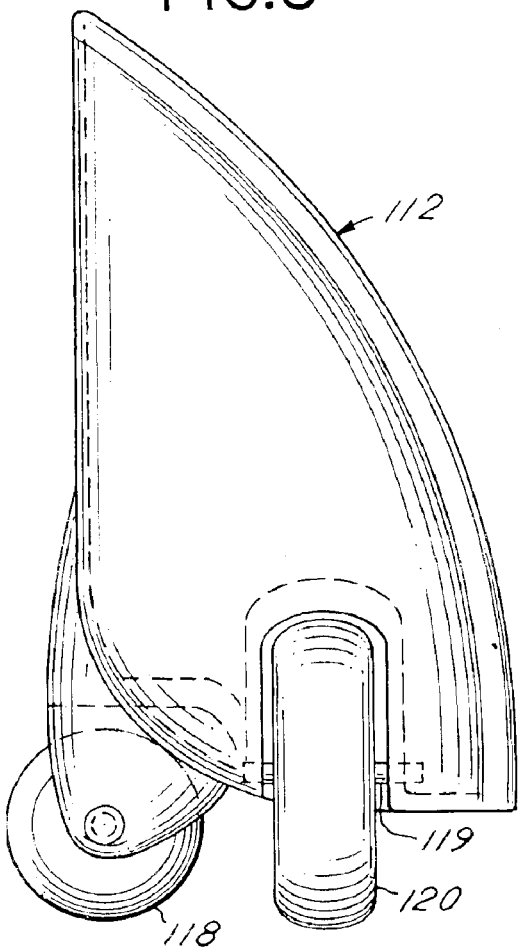
FIG. 8 is a front elevation of the dual wheel assembly associated with a corner of the luggage item of FIG. 5.

Referring to the figures, an item of luggage or a carrying case 10 includes a base 12 and four upstanding side walls or lateral sides 14, 16, 18, 20 extending upwardly from each side of the rectangular base 12. A handle, such as a telescopic handle 22 may be incorporated in the case 10. A strap 23 or other alternative handle means may be provided attached to any side or edge of the luggage. Also the luggage may have alternate shapes yet still incorporate the wheels of the invention.

The luggage base 12 is generally rectangular in shape and includes four sides defining the base. In the embodiment depicted, a wheel assembly, as described below, is attached at each corner of the base 12 or, in other words, at the intersection of each pair of sides of the base 12. In a preferred embodiment, wheel assemblies are attached to at least two adjacent corners of the base 12. Alternatively, wheel assemblies are attached to two, three or four corners of the base 12.

Preferably, the separate wheel assemblies each have a substantially similar construction. Thus, a description of the wheel assembly depicted in FIGS. 2–4 shall apply to each and every corner wheel assembly in the embodiment of FIGS. 1–4, except to the extent that the wheel assemblies have a right hand or a left hand configuration. The wheel assemblies are designed to fit onto the corners of the base and include a means for attaching the wheel assemblies to the base or bottom 12 and lateral sides 14, 16, 18, 20 which come together and join at the corners of the base 12 and extend upwardly from the base 12.

Thus, referring to FIGS. 2–4, a typical wheel assembly includes a housing 30. The housing 30 is comprised of a vertically, upward, planar side panel 32. The panel 32 includes a molded rib 34, for example, with molded passages 36 and 38 therethrough for receipt and attachment of rivets to hold the panel 32 on a side, for example, side 20 of the luggage case 10. The side panel 32 is curved or formed to fit over the corner of the case 10.

The wheel assembly housing 30 further includes a second side panel 40 attached to the first side panel 32 at right angles thereto. The second side panel 40 includes a molded passage 42 for attaching a rivet or fastener 31 therethrough to affix the side panel 40 to a side of the case 10.

The wheel assembly housing 30 further includes a reinforcing bottom or under side or panel 50 which constitutes a smooth continuation or curved wall of the side panel 40. Additionally, molded within the assembly or housing 30, is a first channel 60 and an intersecting channel 62. The channels 60 and 62 intersect each other at right angles in plan view as illustrated in FIG. 4. The channel 60 includes an axle 64 extending between the sides of the channel 60 and defining an axis 66. The axle 64 supports a wheel 68 in the channel 60.

In a similar manner, an axle 70 is positioned in the channel 62 and defines an axis 72. A wheel 74 is supported by the axle 70. The axis 66 and axis 72 intersect at right angles to each other. Wheel 68 and wheel 70 are preferably non co-planar, as shown in FIG. 2, when the wheel assembly 30 is attached to the base 12. In any event the base 12 is maintained in a generally horizontal orientation by the wheels touching a support surface. Thus, the wheels 68 and 74 may serve as pads or supports to maintain the case 10 in a fixed supported position when the case or luggage 10 is not tilted and is in a rest or stationary position.

However, when the case 10 is tilted, for example, by gripping of the handle 22, the case 10 will be tilted about the axis 66 or 72. Such tilting will cause the alternate wheels to be raised or elevated and disengaged from the surface. Thus, the case 10 may be towed or moved without engagement of the elevated wheels with a surface.

The wheels 68, 74 may also be arranged so that they are all simultaneously engaged with a flat planar surface. The choice of wheel diameter and the position of the respective rotational axes of the wheels will, in part, be dependent upon the size and shape of the luggage including the height and angle of inclination comfortable and practical for use of the luggage item. Importantly, pairs of wheels which provide rolling capability should be arranged with substantially identical axle position and wheel size, and such pairs are typically at opposite sides of the luggage 10. In the embodiment depicted, the wheels 68, 74 have distinct diameters and the axles (64, 70) are not coplanar. However, pairs of same sized wheels 68, 74 are in an identical orientation at opposite ends of each side of the base 12 of the luggage 10.

By maintaining the channels 60 and 62 at right angles and the respective axes 66 and 72 at right angles and the wheel assemblies 30 mounted on corners of the base 12, it is possible to provide for support of the parallelapiped shaped case 10 in the rest position or provide for ease of transport of the case 10 when it is tilted in any one of the four directions associated with the four sides 14, 16, 18, 20 of the case 10.

It is noted that the panel 40, insofar as the definition of the channel 62 is concerned, is comprised of outwardly extending flanges, such as flange 41, which support the axle 70 for the wheel 74. The axis 72 of the wheel 70 thus is generally aligned with the panel 40 to enhance the stability of the assembly. On the other hand, it is noted that the axis 66 and the axle 60 are recessed within the channel 60. Thus, the wheel 64 remains recessed relative to the associated side of the luggage case 10 and does not project obtrusively therefrom. In this manner, the wheels are arranged so as not to protrude excessively from the sides of the case 10 thereby enabling the case 10 to conform with airline luggage carry on size requirements, for example.

In a preferred embodiment, the size of the wheels 68, 74 in any single housing is varied slightly. For example, wheels 74 may have a diameter less than wheels 68 and thus when the respective axles 70 and 64 are aligned or coplanar, the larger diameter wheels 68 will serve as luggage supports. However, either set of wheels 68, or 74 may facilitate movement of the luggage when the luggage is tilted to raise one set of wheels from a surface. By adjusting the diameter of wheels 68, 74 or the relative position of the axles (64, 70) between non coplanar and planar, sets of two parallel wheels are oriented and maintained at the same elevation to facilitate luggage movements and avoid dragging of wheels 68, 74 arranged at right angles to each other.

Figure 9:
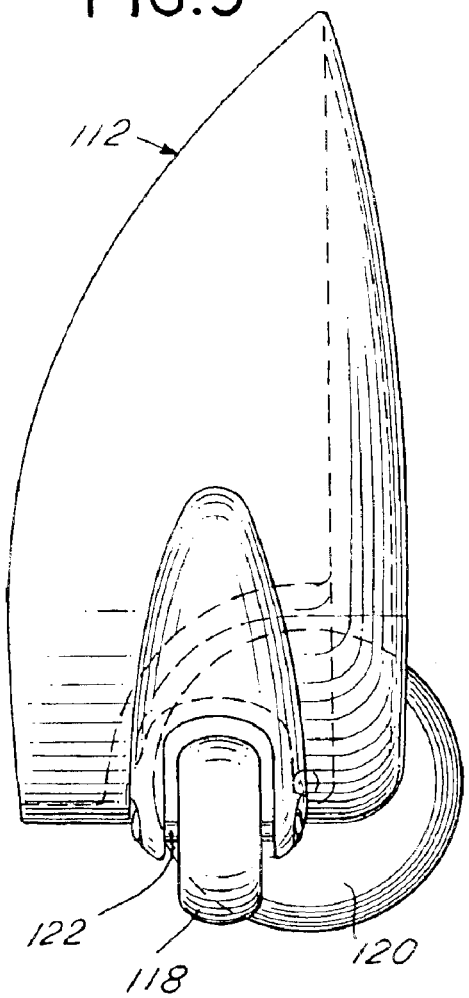
FIG. 9 is a side elevation of the wheel assembly of FIG. 8.
Figure 10:
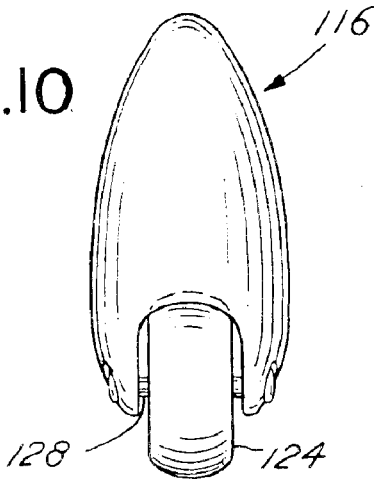
FIG. 10 is a front elevation of the wheel assembly utilizing a single wheel in the embodiment depicted in FIG. 5.
Figure 11:
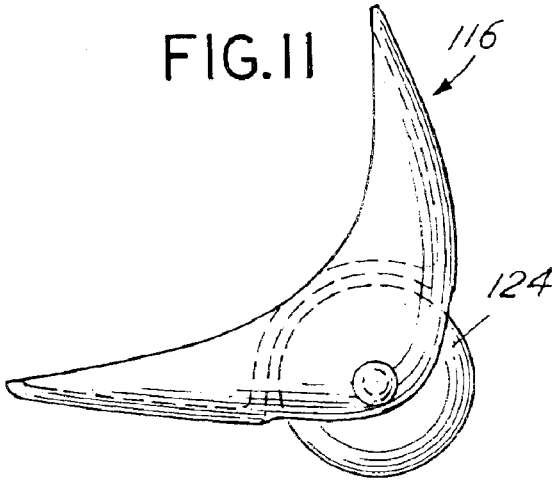
FIG. 11 is a side elevation of the wheel assembly of FIG. 10.

FIGS. 5 through 11 depict an alternative embodiment. Specifically, a case or luggage item 100 having a handle 102 telescoping from the top 104 is positioned so that the case 100 may be tilted for transport on wheels arranged on the bottom 106 of the case 100. More particularly, a first dual wheel assembly 110 is arranged at one corner at the bottom edge of the luggage case 100, and a second dual wheel assembly 112 is arranged at the opposite corner of the case 100. Arranged adjacent the first dual wheel assembly 110 and positioned at a corner spaced therefrom is a single wheel assembly 114. Similarly, a single wheel assembly 116 is positioned adjacent another corner of the case 100 spaced from the second dual wheel assembly 112. In the embodiment, depicted the wheel assembly 110 includes a small diameter wheel 118 and a larger diameter wheel 120. Axle 122 for wheel 118 and axle 119 for wheel 120 are generally coplanar and at right angles with one another. However, because of the distinct diameter of the wheels 118 and 120, the wheels 118, 120 will not drag when the case is tilted or when the case is in the upright position as, for example, illustrated in FIG. 7. Wheel 118 has a lesser diameter than wheel 120. Wheel 118 has a diameter substantially equal to the diameter of a wheel 124 located at an adjacent corner of the base of the luggage. The axles of wheels 118 and 124 are aligned as are the axles of wheels 120.

The auxiliary single wheel assemblies 114, 116 each include a wheel 124 that's mounted in a housing 126 for rotation about an axle 128. The single auxiliary wheel 124 has a diameter substantially equal to the diameter of wheel 118. Additionally, the axles 122 and 128 are substantially coplanar and parallel with each other so that upon appropriate tilting of the case, for example, in the direction depicted by the arrow in FIG. 7, the wheels 118 and 124 will properly and equally meet with the floor or support surface. This will promote smoother transport or running of the case 100 as it is moved when tilted about the axis of the axles 122 and 128. The dual wheel assembly 110 which incorporates the small diameter wheel 118 and the large diameter wheel 120 are likewise positioned within a molded plastic housing 121 which is affixed to a corner of the case 100. The wheels 118 and 120 are arranged at substantially right angles to one another in the manner previously described. Each wheel 118, 120, 124 is positioned in a channel which is substantially vertical. As with the embodiment of FIGS. 1–4, the channels of assembly 112 are at substantially right angles.

It will be noted that with the construction of the present invention, the use of a dual wheel assembly at adjacent corners which are then paired with single wheel constructions at the remaining corners will enable tilting of the carrying case in any of three directions as illustrated in FIGS. 5 and 7 by the arrows in those figures. This will provide a large degree of freedom for movement of the carrying case or luggage device 100.

It is possible to vary the construction described without departing from the intent and scope of the invention. For example, the two wheels associated with each housing may be oriented with respect to each other at angles other than 90° depending, in part, upon the shape of the case or luggage. The invention is therefore to be limited only by the following claims and equivalents thereof.

What is claimed is:

1. Portable luggage comprising, in combination:

a luggage case having a generally four sided base and side panels attached to each side of the base, a corner at the intersection of each pair of sides with the base, said base defining a plan view;

a handle for toting the luggage; and a wheel assembly positioned at two adjacent corners of the base, each said wheel assembly including a housing, each said housing including a first vertical wheel channel and a second vertical wheel channel, said channels arrayed at a right angle with respect to each other and each channel including an axle with a wheel mounted thereon, each of said wheel axles defining an axis, said wheel axes in each housing forming a right angle of wheel rotation in plan view, said wheels each projecting below the base for support of the base thereon and for rotation about their respective axles, two of said wheels on one side of the base at said two adjacent corners being parallel for rotation about parallel axes.

2. The luggage of claim 1 further including a single auxiliary wheel mounted at each of the remaining corners, said auxiliary wheels generally parallel to at least one wheel of the wheel assemblies at said two adjacent corners.

3. The luggage of claim 1 or claim 2 wherein the parallel wheels at said two adjacent corners have a substantially same diameter and axis of rotation.

4. The luggage of claim 1 or claim 2 wherein the parallel wheels at the two adjacent corners on one side of the base have a diameter greater than the diameter of the remaining wheels at the two adjacent corners.

* * * * *